United States Patent [19]

Fonio

[11] 4,436,296

[45] Mar. 13, 1984

[54] FEEDER DEVICE FOR FOLDING MACHINES

[75] Inventor: Carlo Fonio, Galliate, Italy

[73] Assignee: Rockwell International Corporation, Pittsburgh, Pa.

[21] Appl. No.: 276,855

[22] Filed: Jun. 24, 1981

[30] Foreign Application Priority Data

Jun. 18, 1980 [IT] Italy ..... 22842 A/80

[51] Int. Cl.[3] ..... B65H 29/46

[52] U.S. Cl. ..... 270/31; 242/86.5; 414/911

[58] Field of Search ..... 270/30–31; 414/684, 911; 242/58.6, 56.8, 79, 86.5, 86.52

[56] References Cited

U.S. PATENT DOCUMENTS 2,270,892 1/1942 Nyberg ..... 242/79 X 2,276,479 3/1942 Gilbert ..... 270/31

3,325,118 6/1967 Hall ..... 242/86.5

3,776,541 12/1973 Stumpf ..... 270/31

*Primary Examiner*—A. J. Heinz

[57] ABSTRACT

A feeder device for supporting and unwinding web material from a supply roll in a folding machine. The device is supported by a carriage mounted for reciprocating movement on the machine and includes a conveyor of the driven belt type operatively attached to one end of the carriage. A portion of the conveyor is inclined downwardly and cooperates with supporting surfaces of a selectively movable loader device, mounted on the opposite end of the carriage, to form a hopper-like cradle for supporting a supply roll of web material in position while unwinding the web material and advancing the same to the machine's worksurface where it is caused to be folded into superposed layers.

4 Claims, 3 Drawing Figures

FEEDER DEVICE FOR FOLDING MACHINES

BACKGROUND OF THE INVENTION

The present invention pertains to folding machines and more particularly to an improved apparatus for receiving and positioning a supply roll of web material in a position where it is withdrawn from the roll and advanced to the folding table of said machine.

As is well known to those conversant in the art, web material is advanced to the machine's folding table and with the supply roll being supported on a reciprocating carriage, the material is caused to be folded into a plurality of superposed layers which permit simultaneous cutting of all the layers to any desired configuration for producing articles of clothing or the like.

A well known feeder device for positioning a web supply roll in a folding machine has a hopper-like cradle arrangement that is adapted to support and rotate the roll to effect unwinding of the material therefrom without subjecting the latter to tension as it is advanced to a pair of conventional feed rollers mounted on the forward end of the movable carriage.

The means utilized for rotating and unwinding the web supply roll with known cradle arrangements includes a series of rotatably driven conveyor rollers or endless belts that are disposed so as to be aligned one with the other and which are inclined downwardly toward their adjacent ends thus defining the cradle configuration within which said roll rests.

A cradle arrangement of the type described supra is shown and described in U.S. Patent Application No. 171,761 filed July 24, 1980, wherein the web supply roll is caused to rotate in a rearwardly direction so that the web material being unwound therefrom will advance in a forwardly direction where it is received by and caused to pass between the conventional feed rollers. Although this type of cradle arrangement performs its intended function satisfactorily on certain types of web materials, it has been found to create troublesome conditions with web supply rolls that cannot be compactly wound as is the case with exceptionally thin plastic materials as well as knit fabric. Such materials are easily deformable and stretchable if subjected to excessive tensioning and the lack of compactness of the supply rolls creates a flattening condition of the roll when loaded onto the cradle which alters the circumference thereof. Such a condition will cause an excess accumulation of web material at the rearward side of the roll which will build up to the extent where it fails to be advanced by the conveyor forwardly of the roll to the feed rollers.

Additionally, the known types of folding machines are not provided with a means for removing and replacing those supply rolls which have only been partially exhausted. Prior to the instant invention, replacement of partially used web supply rolls was a manual operation and because of the lack of simplicity in making such replacements, it was rarely undertaken. The feeder device according to the present invention provides a means for readily changing the supply rolls as desired and is adapted to accommodate the most loosely wound rolls so that the web material is satisfactorily unwound therefrom.

SUMMARY OF THE INVENTION

The feeder device for folding machines comprising the invention is formed by the combination of the forward portion of a conveyor that is inclined in a downwardly direction and a roll support apparatus having a pair of spaced support members that extend in parallel relationship and which in their operating position are inclined downwardly. The supply roll is mounted on a shaft, the ends of which rest on the spaced support members and when the latter are moved to their operating position, the shaft will rotate and move the supply roll into contact with the forward inclined portion of the conveyor which together with said inclined support members form a hopper-like cradle for a web supply roll. The support members are operatively connected to a loader device which defines a driven carriage that is selectively movable between a roll loading position and one in which the spaced support members are in operative association with the conveyor where the combination form the hopper-like cradle. Selective movement of the carriage from the roll loading position causes the shaft to roll along the support members and place the web supply roll in contact with the conveyor, and movement in the opposite direction returns said supply to the loading position whereat it can be readily replaced.

It is a general object of the invention to provide a feeder device for folding machines in which a web supply roll is supported in a manner whereby a limited portion of its periphery engages the conveyor with a minimum of pressure which is effective in rotating the roll and advancing the withdrawn web forwardly in a positive manner.

A further object is to provide a feeder device which can be selectively actuated to pivot away from the conveyor to a position that facilitates replacement of the supply roll.

These and other objects of the present invention will become more fully apparent by reference to the appended claims and as the following detailed description proceeds in reference to the figures of drawing wherein:

DESCRIPTION OF THE PREFERRED EMBODIMENT

Figure 1:
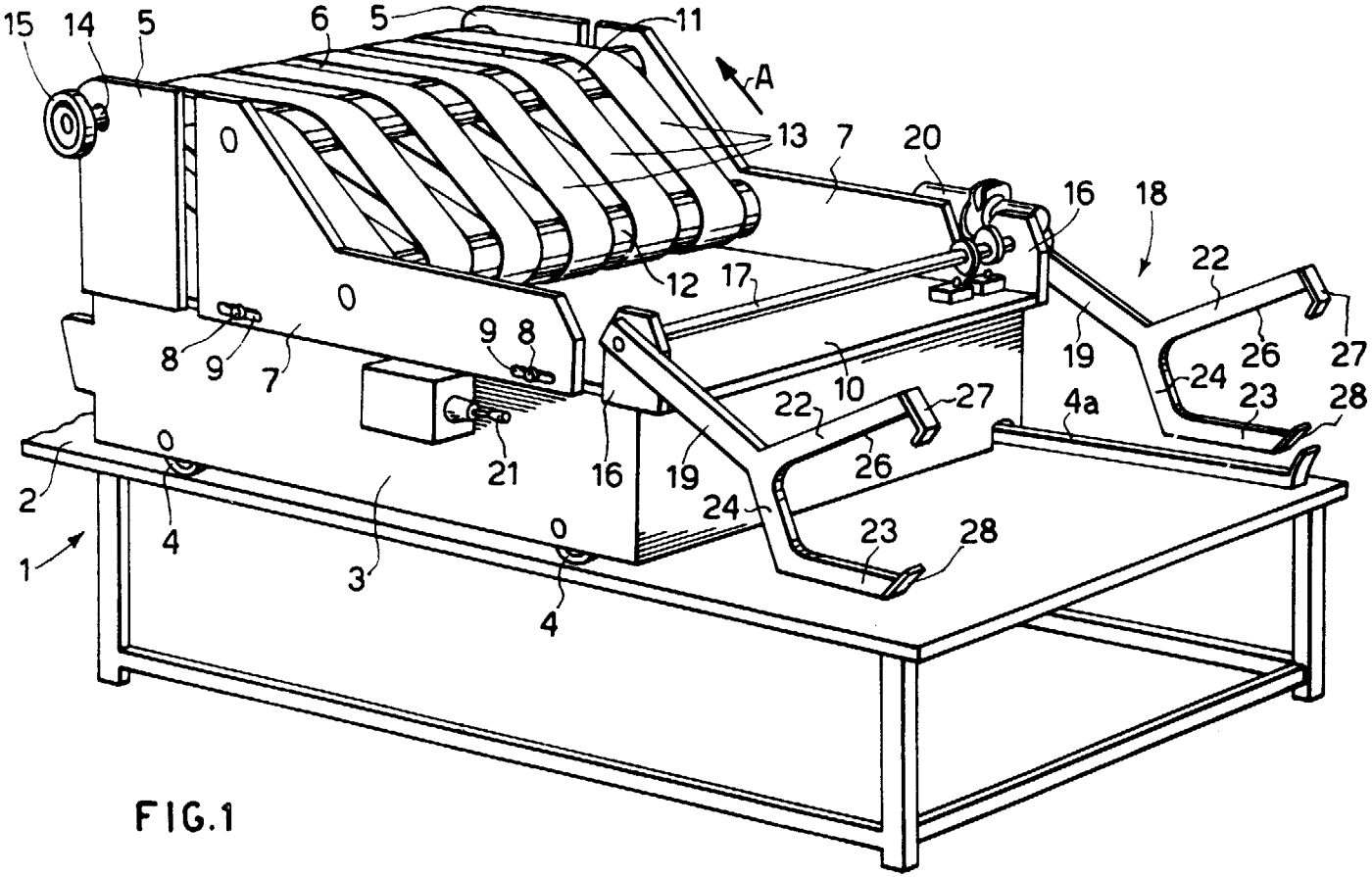
FIG. 1 is a perspective view of a folding machine showing the feeder device according to the invention applied thereto.

Referring now to FIG. 1, a folding machine includes among its many parts a table generally identified by numeral 1 having an upper planar surface that forms the machine's worksurface 2. A carriage 3 having supporting wheels 4 is mounted for reciprocating movement on the worksurface 2 and is guided during such movement by two of its wheels (not shown) being in engagement with a track 4*a*. The movable carriage is of box-like structure and serves to support a conveyor apparatus for advancing web material as it is unwound from a supply roll.

The conveyor apparatus includes the usual drive means for its rollers as well as other operative components that are not shown for they are well known to those conversant in the art. However, for a detailed description of such drives and operative components, attention is hereby directed to U.S. Pat. No. 3,850,424. The conveyor apparatus includes a base plate 10 which is fixed by any suitable means not shown to the carriage 3 and the sides thereof at their forward ends are provided with upwardly directed side plates 5 disposed in opposed relation. Adjacent the upper ends of the side plates 5, the ends of a first cylindrical roller 6 are rotatably supported.

Adjacent the rearward edges of the side plates 5, a pair of opposed side frames 7 are provided which extend rearwardly and are attached adjacent their lower edges to the sides of the base plate 10 by means of cap screws 8 that extend through slots 9 provided in said side frames 7. These side plates 7 serve to rotatably support two additional cylindrical rollers 11 and 12 and as shown in FIG. 1, the cylindrical roller 12 is located in a lower position than the roller 11. One or more conveyor belts 13 are in operative engagement with the peripheries of the cylindrical rollers 6, 11 and 12 and are driven in the direction of the indicating arrow "A" by a drive motor (not shown) that is operatively connected to a clutching device 14 provided with a drive pulley 15.

The arrangement of the two cylindrical rollers 6 and 11 cause the conveyor belts extending therebetween to travel in a horizontal plane and with roller 12 being disposed in a lower position places a portion of said belts in a plane which is inclined downwardly and in the direction toward the rearward end of the carriage 3.

The combination of the cylindrical rollers and their belts defines the forward portion of the feeder device according to the invention and their particular arrangement combined with the rearward portion of the feeder device yet to be described form the hopper-type cradle within which a web supply roll is positioned during the unwinding of the web material therefrom.

The sides of the base plate 10 adjacent its rearward end are each provided with an upwardly directed support bracket 16 that are fixed in opposed relation and serve to rotatably support an actuating shaft 17 adjacent each of its ends which traverses the width of said base plate. The ends of the actuating shaft 17 protrude outwardly beyond the sides of their respective support brackets 16 and each has a forked lever 19 fixed thereon that are disposed in alignment and together define a loader device generally indicated by numeral 18. One end of the actuating shaft 17 is operatively connected to a reduction drive unit 20 that is controlled by a three-position reversing switch 21 that is adapted to control rotation of said shaft 17 in both directions.

Figure 2:
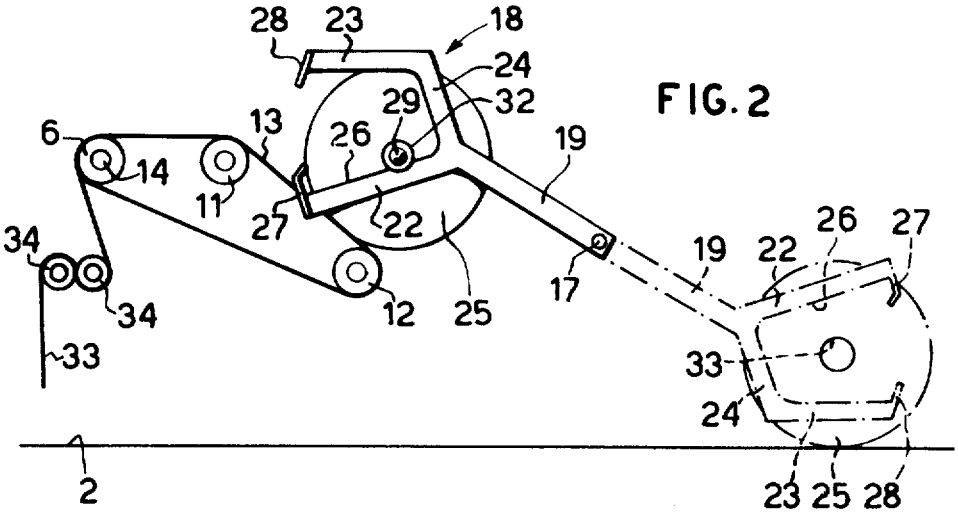
FIG. 2 is a view in side elevation showing the feeder device in operative association with the conveyor and by means of phantom lines, its position for loading or replacing web supply rolls.
Figure 3:
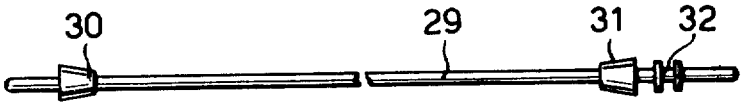
FIG. 3 is a view in side elevation of the shaft for supporting a web supply roll in the feeder device.

With reference to FIGS. 1 and 2, the forked levers 19 are of identical configuration and include a first arm 22 of the forked body portion thereof. The second arm of the forked portion is identified by numeral 23 and diverges at an acute angle from the first arm from which it is spaced by an integral third arm 24 that extends at a right angle from the base of said first arm.

The loader device is particularly essential for the purpose of the invention for the elements for rotatably supporting a web supply roll 25 in operating position are operatively connected thereto. These elements, for rotatably supporting a web supply roll are defined by a pair of spaced and parallel support surfaces 26 which are inclined downwardly so as to be in operative association with the conveyor when the loader device 18 is in its operating position as is shown by the solid lines in FIG. 2.

Each support surface 26 is formed by the inner surface of each first arm 22, or in other words, that surface which faces toward the second arm 23 of the forked levers. As shown in FIGS. 1 and 2, the free ends of the first and second arms 22 and 23 have stop members fixed thereto which are identified by numerals 27 and 28 respectively.

As shown in FIG. 2, the loader device 18 is selectively movable between a first or loading position that is shown by phantom lines and a second or operating position which is shown by solid lines. In its loading position, the forked levers 19 are located adjacent the worksurface 2 where they are adapted to receive a web supply roll 25 having a support shaft 29, extending axially therethrough. The length of this shaft 29 is greater than the distance between the two forked levers 19 and is provided with two conical shaped positioning members 30 and 31 which are adapted to engage the ends of a conventional tube member 33 on which the web material is wound thus centering said shaft within said tube. Additionally, shaft 29 adjacent one of its ends has a grooved wheel 32 fixed thereon which is adapted to be engaged by one of the second arms 23 on the initial movement of the forked levers away from the loading position. When loading a web supply roll 25, it initially rests on the worksurface 2 as shown in FIG. 2 and as the forked levers 19 are caused to move upwardly, their second arms 23 engage the shaft 29 and effect lifting said supply roll. As the forked levers are pivoted upwardly, the shaft 29 and supply roll 25 carried thereby roll forwardly on the second arms 23 and are guided during this movement by the grooved wheel 32. Continued movement of the forked levers causes the shaft 29 and its supply roll to roll along the inner surface of the third arm 24 and thence along the support surfaces 26 of the first arms 22 until said supply roll engages the outer surfaces of the conveyor belts 13 that extend between the cylindrical rollers 11 and 12.

As shown in FIG. 2, the web supply roll 25 is caused to make contact with the inclined portion of the conveyor regardless of said roll's diameter and is adapted to maintain such contact until the supply of web material is exhausted. It is easily understood that this contact can be maintained because the forked levers 19 in their operating positions locate the support surfaces 26 so that they are inclined downwardly and extend to a position of operative association with the downwardly inclined portion of the conveyor.

Additionally, the present invention cooperates with the conveyor to form a hopper-like cradle for web supply rolls which substantially reduces the number of conveyor elements required for roll supporting cradles in folding machines of the prior art and is capable of providing positive and smooth withdrawal or unwinding of the web material 33 to accommodate the rapid advance of said web material to the feed rollers 34 of the folding machine.

A further feature of the invention is that it is a simple matter to rewind the web material 33 when desired by simply reversing the direction of rotation of the drive pulley 15 of the clutching device 14.

From the foregoing description, it should be apparent that the continuous operative contact between the web supply roll 25 and the conveyor which engages only a limited portion of the peripheral surface of said roll, permits the feeder device according to the invention to perform its intended function smoothly and in a positive manner without subjecting the web material to slippage or a pulling force. Additionally, the feeder device permits the pressure with which the supply roll engages the conveyor to be governed by the degree of compactness with which the web material was wound onto the tube member 33. This is made possible because the support surfaces 26 are fixed relative to the loader device and by means of operating the reversing switch 21, it is a simple matter to incline said support surfaces to the most desirable position for a particular web supply roll so that the latter will bear against the conveyor with the most desirable degree of force to effect a smooth and positive unwinding of the web material therefrom.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A feeder device for withdrawing web material from a supply roll supported on a shaft (29) mounted on a folding machine of the type having a worksurface and a carriage mounted for reciprocating movement thereon for effecting advance of the web material onto the worksurface in folded superposed layers, said feeder device comprising:

(a) a conveyor supported on one end of the carriage including:

(i) a plurality of spaced rotatably driven cylindrical rollers (6, 11, 12);

(ii) at least one conveyor belt (13) in driving engagement with each said cylindrical rollers;

(b) a loader device (18) pivotally mounted at one end thereof to an end of the carriage opposite said conveyor and being bifurcated at an opposite end, said bifurcation being formed by opposed arms, one of said arms having a support shaft (29) receiving portion for lifting the shaft (29) and web supply roll (25) mounted thereon from a loading position, the other arm includes a support surface (26) that supports the shaft to allow the supply roll (25) to lie against the conveyor belt (13) when said loader device is in a feed position to cause paying out of material from the roll (25), said support surface (26) of said other arm being elongated and merging with the shaft receiving portion to form a continuous path for the shaft (29) to move along, said support surface (26) forming an inclined ramp when the loader device (18) is situated in the feed position to cause the shaft (29) to move there along and carry the support roll (25) into and for continuous engagement with the conveyor belt (13); and (c) drive means for pivoting said loader device with said web supply roll between the loading position adjacent the worksurface to the feed position.

2. A feeder device as defined in claim 1 wherein at least a portion of said one arm receiving portion extends substantially parallel to the worksurface which receives material from the carriage.

3. A feeder device as disclosed in claim 2 wherein and elongated support surface (26) of said other support arm is substantially linear so that it extends upwardly and outwardly from the plane of conveyor belt (13).

4. A feeder device as defined in claim 3 wherein said arms (22) (23) have stop means (27) (28) affixed to the free ends thereof to limit the movement of the support shaft (29).

* * * * *